US008284012B2

(12) United States Patent
Cole et al.

(10) Patent No.: US 8,284,012 B2
(45) Date of Patent: Oct. 9, 2012

(54) ULTRA-STABLE REFRACTORY HIGH-POWER THIN FILM RESISTORS FOR SPACE APPLICATIONS

(75) Inventors: Robert C. Cole, Rancho Palos Verdes, CA (US); Gouri Radhakrishnan, Rancho Palos Verdes, CA (US)

(73) Assignee: The Aerospace Corporation, El Segundo, CA (US)

( * ) Notice: Subject to any disclaimer, the term of this patent is extended or adjusted under 35 U.S.C. 154(b) by 652 days.

(21) Appl. No.: 12/478,376

(22) Filed: Jun. 4, 2009

(65) Prior Publication Data

US 2010/0308955 A1 Dec. 9, 2010

(51) Int. Cl.
*H01C 7/10* (2006.01)

(52) U.S. Cl. ..... 338/22 R

(58) Field of Classification Search ..... 338/22 R
See application file for complete search history.

(56) References Cited

U.S. PATENT DOCUMENTS

| | | | | |
|---|---|---|---|---|
| 3,665,599 | A * | 5/1972 | Herczog et al. | 29/620 |
| 5,118,983 | A * | 6/1992 | Morita et al. | 313/340 |
| 5,155,340 | A * | 10/1992 | Morita et al. | 219/543 |
| 5,221,422 | A | 6/1993 | Das et al. | |
| 5,392,982 | A | 2/1995 | Li | |
| 5,705,793 | A * | 1/1998 | Kitaichi et al. | 219/544 |
| 5,858,478 | A * | 1/1999 | Radhakrishnan | 427/571 |
| 5,874,175 | A | 2/1999 | Li | |
| 6,024,851 | A * | 2/2000 | Radhakrishnan | 204/298.02 |
| 6,416,374 | B1 * | 7/2002 | Mitome et al. | 445/6 |
| 6,799,531 | B2 | 10/2004 | Cadieu | |
| 6,960,111 | B2 * | 11/2005 | Takegami et al. | 445/24 |
| 6,992,428 | B2 * | 1/2006 | Kyogaku et al. | 313/310 |
| 2002/0051848 | A1 | 5/2002 | Li | |
| 2003/0124944 | A1 * | 7/2003 | Kyogaku et al. | 445/6 |
| 2004/0108937 | A1 * | 6/2004 | Ernsberger et al. | 338/309 |
| 2005/0063659 | A1 * | 3/2005 | Jansen | 385/130 |
| 2007/0023751 | A1 * | 2/2007 | Shoji | 257/59 |
| 2007/0176532 | A1 * | 8/2007 | Yamamoto et al. | 313/496 |
| 2009/0056805 | A1 * | 3/2009 | Barnett et al. | 136/256 |
| 2010/0308955 | A1 * | 12/2010 | Cole et al. | 338/307 |

FOREIGN PATENT DOCUMENTS

WO WO 02/057507 A3 7/2002

OTHER PUBLICATIONS

Radhakrishnan, G.; Adams, P.M., "Pulsed-laser deposition of particulate-free TiC coatings for tribological applications," *Applied Physics A: Materials Science & Processing*, vol. 69, No. 7 (Published online: Dec. 22, 1999), pp. S33-S38.

(Continued)

*Primary Examiner* — James Harvey
(74) *Attorney, Agent, or Firm* — Henricks, Slavin & Holmes LLP

(57) ABSTRACT

A method of fabricating a thin film resistor including providing a substrate, using a low-temperature pulsed-laser deposition process to deposit a titanium carbide (TiC) layer on the substrate, removing portions of the TiC layer with an etching process to leave a TiC pattern on the substrate, and depositing conductive material on opposite ends of the TiC pattern to provide a thin film resistor.

21 Claims, 3 Drawing Sheets

OTHER PUBLICATIONS

Rawat, R. S.; Lee, P.; White, T.; Ying, L.; Lee, S., "Room temperature deposition of titanium carbide thin films using dense plasma focus device," *Surface and Coatings Technology*, vol. 138, Issues 2-3 (Available online: Apr. 13, 2001), pp. 159-165.

Radhakrishnan, G.; Robertson, R. E.; Adams, P. M.; Cole, R. C., "Integrated TiC coatings for moving MEMS," *Thin Solid Films*, vols. 420-421, Proceedings of the 29th International Conference on Metallurgic Coatings and Thin Films (Dec. 2, 2002), pp. 553-564.

* cited by examiner

TiC Resistor Thin Film Fabrication Process

MEMS Device Including Thin Film Resistor Microheaters

ULTRA-STABLE REFRACTORY HIGH-POWER THIN FILM RESISTORS FOR SPACE APPLICATIONS

STATEMENT REGARDING FEDERALLY SPONSORED RESEARCH OR DEVELOPMENT

The invention was made with Government support under contract No. FA8802-04-C-0001 by the Department of the Air Force. The Government has certain rights in the invention.

TECHNICAL FIELD

The invention relates generally to thin film resistors and, in particular, to titanium carbide (TiC) thin film resistors formed using a low-temperature pulsed-laser deposition process.

BACKGROUND ART

Nichrome and tantalum nitride resistor films are well characterized and their limitations are well understood. Nichrome thin film precision resistors have been the material of choice for many years for use in hybrid microcircuits and resistor networks. Likewise, the deposition processes used to create these films have been described. In general, deposited films in excess of a few hundred angstroms can produce sheet resistivities of 50 to 350 ohms/square for nichrome and 50 to 150 ohms/square for tantalum nitride. Long term stability of properly stabilized and trimmed nichrome resistors results in significantly less than a 0.5% change in value over 1000 hours at 125° C. when in air. Nichrome resistors are sensitive to moisture under typical bias loads in circuit applications. This requires the resistors to be coated with a moisture resistant conformal coating. The mitigation for moisture susceptibility of coating the resistors adds expense and additional testing requirements during fabrication. Such coatings are problematic and have led to yield loss, extensive rework procedures, and system failures in critical subsystems. Many system manufacturers require the use of high precision and reliable thin film resistors, particularly for complicated designs. It would be useful to be able to provide a thin film resistor that offers chemical and thermal stability along with a temperature coefficient of electrical resistance similar to that of nichrome (i.e., low bulk resistivity).

Titanium Carbide (TiC) has a low bulk resistivity of 150 ohm/square, chemical inertness, mechanical strength, and a high melting point of about 3500° K. However, with respect to temperature sensitive semiconductor substrates, TiC films are difficult to deposit at room temperature using conventional vacuum deposition. It would be useful to be able to fabricate a thin film resistor on a temperature sensitive substrate without damaging the substrate such that the resulting thin film resistor has high chemical and mechanical stability while still providing sufficiently low bulk resistivity.

SUMMARY OF THE INVENTION

Example embodiments described herein involve the fabrication and utilization of titanium carbide (TiC) films as a new and ultra stable resistor material in the production of quality thin film resistors. In an example embodiment, a film of TiC is first deposited using a low temperature and low pressure deposition process for depositing the film on a substrate. Pulsed laser deposition is used to deposit a TiC thin film on the substrate. The TiC thin film is covered with a first masking layer, such as a conventional first photoresist layer that is in turn exposed and developed using conventional lithographic processes into a first patterned mask layer. The TiC thin film resistor pattern is produced by etching the surrounding field layer of TiC not covered by the protective photoresist layer. This first patterning mask layer is then removed using conventional lithographic processes. A second photoresist layer is then coated on the patterned TiC thin film. This second layer is imaged using standard photolithographic processes to form windows for the electrical contacts to the TiC resistors. To deposit contacts, a conducting material, such as gold, is deposited over the entire substrate containing the patterned TiC resistors. This is a standard process for selectively depositing contact material through holes in the second patterned mask layer onto the patterned TiC thin film. The second patterned masked layer is then removed using conventional lithographic processes. The result is a patterned thin film TiC resistor with thin film metal contacts.

Titanium carbide (TiC) patterned thin film resistors are fabricated using pulsed laser deposition, combined with a first mask that defines the patterned thin film using reactive ion etching (RIE) and a second mask that defines contact locations on the thin film resistor for contacts, such as gold contacts deposited by electron beam evaporation deposition, with the resistor being deposited on a sapphire or alumina substrate, with the resistors having high chemical resistance and low temperature coefficients, well suited for high reliability and precision RF circuit applications.

The TiC thin film can be patterned into various design patterns such as serpentine patterns, complex latter networks with conducting contacts at opposing ends of the resistor pattern. The TiC thin film can be laser trimmed to precisely set resistive values.

In an example embodiment, a method of fabricating a thin film resistor including providing a substrate, using a low-temperature pulsed-laser deposition process on a target to deposit a titanium carbide (TiC) layer on the substrate, removing portions of the TiC layer with an etching process to leave a TiC pattern on the substrate, and depositing conductive material on opposite ends of the TiC pattern to provide a thin film resistor.

In an example embodiment, a method of increasing the power handling capabilities of electronics includes providing the electronics with one or more titanium carbide (TiC) thin film resistors where power is applied to the electronics.

In an example embodiment, an electronics component including a substrate, a titanium carbide (TiC) thin film layer patterned on the substrate, and conductive terminals formed to provide ohmic contacts on opposite ends of the TiC thin film layer to provide a TiC thin film resistor.

In an example embodiment, a space-environment tolerant ultra-stable refractory high-power electronics device including circuitry that includes one or more titanium carbide (TiC) thin film resistors.

DISCLOSURE OF INVENTION

Figure 1:
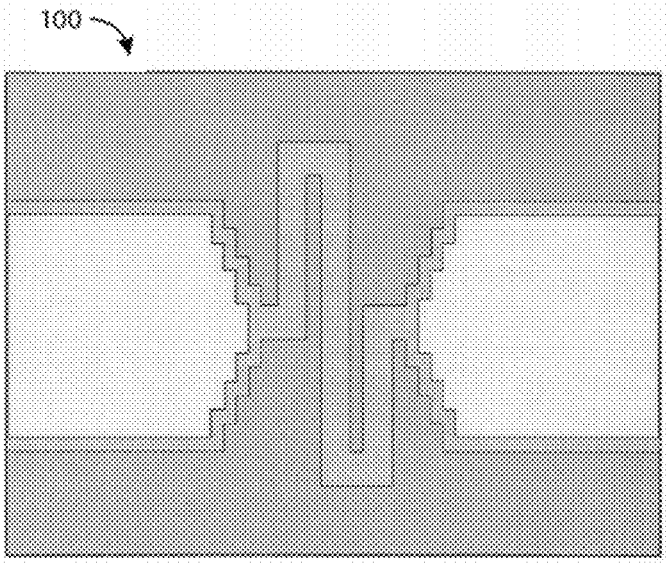
FIG. 1 is a top view of an example TiC thin film resistor.
Figure 2A:
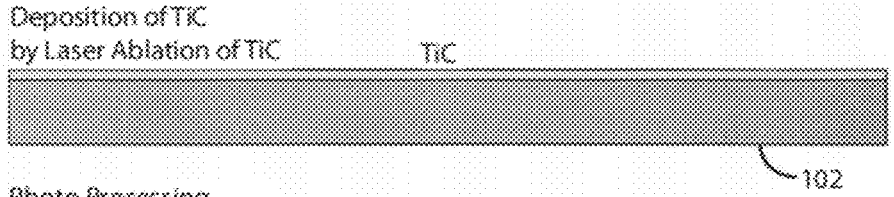
FIGS. 2A-2D show, in cross-sectional views, steps during an example TiC thin film resistor fabrication process.
Figure 2B:
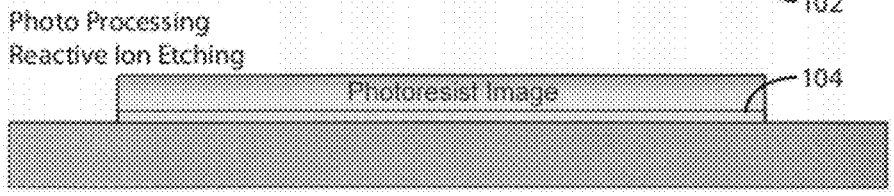
Figure 2C:
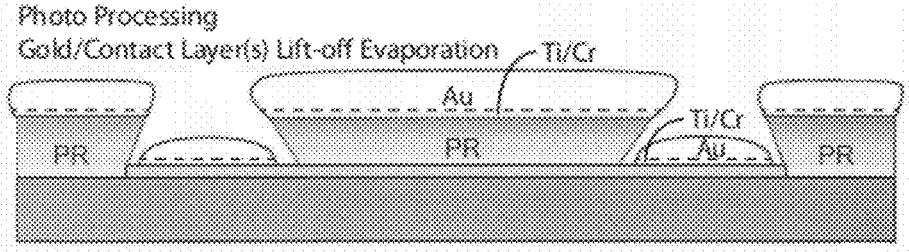
Figure 2D:
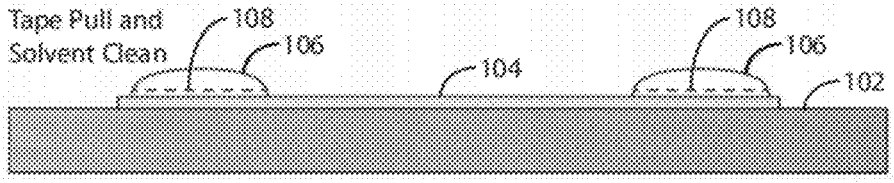

Referring to FIGS. 1 and 2A-2D, in an example embodiment, a TiC thin film resistor 100 (or other electronics component) includes a substrate 102, a titanium carbide (TiC) thin film layer 104 patterned on the substrate 102, and conductive terminals 106 formed in ohmic contact with opposite ends of the TiC thin film layer 104.

The substrate 102 can be a single crystal sapphire substrate, or other suitably hard non-electrically conductive substrates, such as oxidized silicon. In an example embodiment, the substrate 102 is formed from one or more of: silicon on sapphire (SOS), silicon oxide, sapphire, and alumina (polycrystalline sapphire).

The TiC thin film layer 104 has a low temperature coefficient of electrical resistance. Additionally, the TiC thin film layer 104 is compatible with silicon lithographic processes and inorganic acids commonly used for silicon wafer processing technology and can be patterned and etched using reactive ion etching techniques. In an example embodiment, the TiC thin film layer 104 is formed to mimic the crystallinity of the target, e.g., the starting TiC disc or cylinder that is subjected to a laser ablation process. In an example embodiment, the TiC thin film layer 104 is polycrystalline.

In an example embodiment, the conductive terminals 106 include gold. In another example embodiment, the conductive terminals 106 include TiC, chromium and gold. It should be appreciated that the conductive terminals 106 can be formed from other materials and/or combinations of materials.

In an example embodiment, the conductive terminals 106 include an adhesion layer 108 (e.g., titanium, chromium) covering the TiC thin film layer 104. See FIGS. 2C and 2D. Other materials suitable for providing ohmic contact with the TiC thin film layer 104 can also be used.

Figure 3:
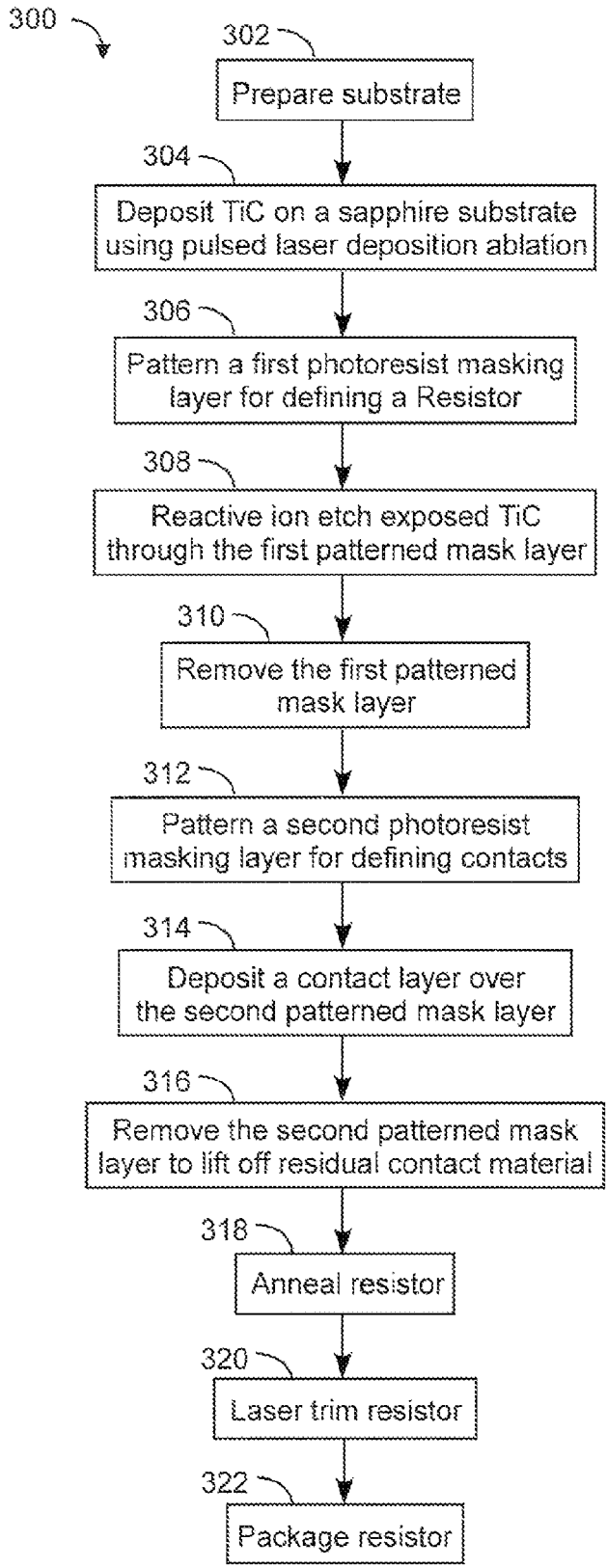
FIG. 3 is a flow diagram of an example TiC resistor thin film fabrication process.

Referring to FIG. 3, an example TiC resistor thin film fabrication process 300 includes several well-known processes. Typical processes, not shown, include cleaning a substrate in preparation for TiC deposition.

After preparing a suitable substrate, at 302, a deposition technique such as pulsed laser deposition (PLD) is used, at 304, to deposit the TiC thin film layer 104 (e.g., a polycrystalline thin film of TiC). In an example embodiment, a low-temperature (e.g., room temperature) pulsed-laser deposition process is used to deposit a titanium carbide (TiC) layer on the substrate. See, e.g., Radhakrishnan, G., Adams, P. M., "Pulsed-laser deposition of particulate-free TiC coatings for tribological applications," Applied Physics A Materials Science & Processing, Volume 69, Issue 7, pp. 33-38 (1999). In an example embodiment, a room temperature laser ablation process is used to deposit the TiC thin film layer on the substrate.

In an example embodiment, a low-temperature pulsed-laser deposition process mimics the crystallinity of the substrate resulting in the thin film resistor being polycrystalline. The term "low-temperature" means room-temperature plus or minus 10 degrees (typically, 27° C.±10° C.) as measured with a thermocouple beneath the substrate.

In an example embodiment, the low-temperature pulsed-laser deposition process is also performed at a low pressure. The term "low pressure" means less than $10^{-6}$ Torr e.g $10^{-6}$ to $10^{-10}$ Torr.

After depositing the TiC thin film on the substrate, at 306, a first patterned masking layer is applied. The first patterned masking layer can be applied using conventional photolithography. The first patterned making layer can be applied by depositing a photoresist layer that is then patterned, developed, and cleaned providing a positive image of the a desired thin film pattern using conventional photolithography.

After patterning the first masking layer, at 308, the unwanted portions of the TiC film are removed, for example, by reactive ion etching (RIE). This removes the unwanted TiC film from the surrounding field leaving the resistor material under the protective photoresist. After etching the TiC thin film into a desired resistor pattern, the first masking layer is removed, at 310, exposing the desired TiC patterned resistor deposited on the substrate.

After removing the first masking layer to expose the patterned TiC thin film, at 312, a second masking layer is applied. The second masking layer is patterned, developed and cleaned using conventional photolithography. The second patterned masking layer provides vias or contact patterns through which a conducting material can be deposited.

After patterning the second masking layer, at 314, a conducting material is deposited over the second masking layer. The conducting material is deposited through the holes to form contacts on the patterned TiC thin film while residual portions of the conducting material are concurrently deposited over remaining portions of the second masking layer. The conducting material is preferably a metal, such as gold, which can be deposited preferably using an electron beam evaporation deposition process. The contacts may be complicated structures such as a tri-layer contact of titanium, chromium, and gold for improved adhesion. Each material used to form the contact would include a respective deposition process. The titanium, chromium, and gold portions of the contact layers in the field would then be removed or "lifted off" when the second masking layer is removed, at 316, leaving behind the contacts made of the conducting material deposited on the patterned TiC thin film. After completely forming the patterned TiC thin film resistor, at 318, the resistor can be annealed for long term stability, such as 300° C. for 1 hour. At 320, if needed, the resistor is laser trimmed. Thereafter, the wafers can be diced into chips, and the chips can be packaged for use, at 322, such as being packaged in dual inline packages. Packaging normally includes gold wire bonding the contact to electrical leads of a package.

Electrical and environmental testing can then be performed on these patterned TiC thin film resistors. Data has shown electrical stability over a wide temperature range and stability during temperature cycling, demonstrating that ultrastable refractory high-power thin film TiC resistors are suitable for high-reliability space applications. For example, six resistors were selected per chip for testing using a Kelvin four terminal arrangement for the wire bonding to eliminate contact resistance and improve measurement precision.

The resistors can also be tested using standard evaluation methods. For example, V-I monitoring at high temperature bake at 150° C. for 100 hrs can be used to determine the stability of resistance over long term temperature stress. V-I monitoring during temperature cycling from −55° C. to +125° C. was used to determine the temperature coefficient of resistance of the TiC material. Voltage-sweep analysis from −10 Volts to +10 Volts was used to determine the conductive behavior of the thin film TiC resistors.

Initial electrical testing results show distinct temperature dependence for resistors made from TiC. The temperature coefficient of resistance values for the annealed devices ranged from −70 to −90 ppm/° C. After a high-temperature anneal of the devices at 300° C. for 1 hour, the resistors were very stable over a long duration when measured and manifested a resistance change of less than 2 ppm at 150° C. for 100 hours.

Figure 4:
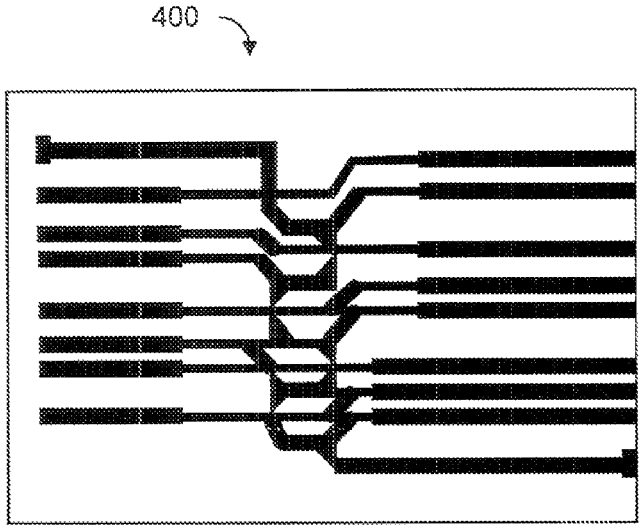
FIG. 4 shows an example thin film resistor network.

Various electronics components can be made from the TiC thin film resistor described herein. By way of example, and referring to FIG. 4, a patterned TiC thin film resistor network 400 can be fabricated.

Thin film resistors fabricated from TiC are extremely tolerant to high pulse power applications and suitable for use, for example, in medical defibrillators.

Figure 5:
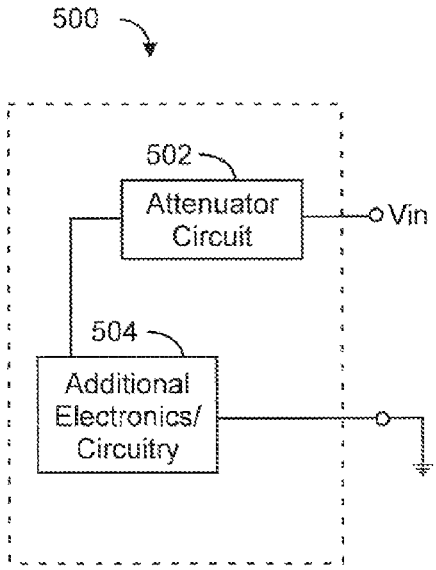
FIG. 5 is a diagram of electronics/circuitry that includes an attenuator circuit formed with a TiC thin film material.

The TiC thin film resistors described herein are suitable for high reliability with low temperature coefficients, such as RF applications. Referring to FIG. 5, electronics/circuitry 500 include an attenuator circuit 502 (formed with a TiC thin film material described herein) and additional electronics/circuitry 504. In an example embodiment, the attenuator circuit 502 is an RF attenuator. The TiC thin film material provides high thermal stability and stability at high frequencies on RF sapphire and alumina substrates.

In an example embodiment, the electronics/circuitry 500 provide a space-environment tolerant ultra-stable refractory high-power electronics device that includes one or more titanium carbide (TiC) thin film resistors. By way of example, the electronics/circuitry 500 can include: a resistor network, a microwave amplifier, a power supply, a power distribution module, micro-electro-mechanical systems (MEMS) devices, as well as other devices and components.

As exemplified in FIG. 5, a method of increasing the power handling capabilities of electronics includes providing the electronics/circuitry 500 with one or more titanium carbide (TiC) thin film resistors where power is applied to the electronics/circuitry 500. In an example embodiment, the one or more titanium carbide (TiC) thin film resistors are configured as an RF attenuator.

Figure 6:
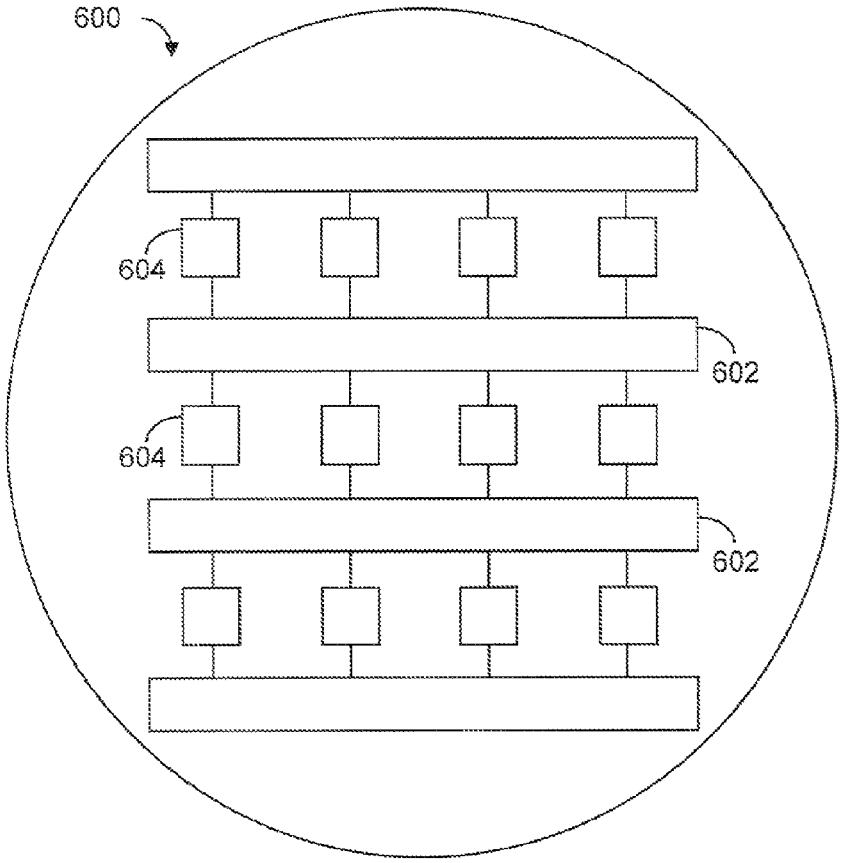
FIG. 6 shows a Micro-electro-mechanical system (MEMS) device including TiC thin film resistor microheaters.

Referring to FIG. 6, in an example embodiment, a micro-electro-mechanical systems (MEMS) device 600 includes devices 602 and titanium carbide (TiC) thin film resistors configured as MEMS microheaters 604.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A method of fabricating a thin film resistor, the method comprising the steps of:

providing a substrate;

using a room temperature pulsed-laser deposition process on a target to deposit a titanium carbide (TiC) layer on the substrate;

removing portions of the TiC layer with an etching process to leave a TiC thin film layer patterned on the substrate; and forming conductive terminals by depositing conductive material on opposite ends of the TiC pattern to provide ohmic contacts on opposite ends of the TiC thin film layer to provide a TiC thin film resistor;

wherein the TiC thin film layer has a crystalline structure mimicking the crystallinity of a target utilized during the room temperature pulsed-laser deposition process of depositing the TiC thin film layer on the substrate.

2. The method of fabricating a thin film resistor of claim 1, wherein the substrate is formed from one or more of: silicon on sapphire, silicon oxide, sapphire, and alumina.

3. The method of fabricating a thin film resistor of claim 1, wherein the room temperature pulsed-laser deposition process mimics the crystallinity of the target resulting in the thin film resistor material being polycrystalline.

4. The method of fabricating a thin film resistor of claim 1, wherein the room temperature pulsed-laser deposition process is performed at a low pressure.

5. The method of fabricating a thin film resistor of claim 1, wherein the etching process is reactive ion etching.

6. The method of fabricating a thin film resistor of claim 1, wherein the conductive material includes gold.

7. The method of fabricating a thin film resistor of claim 1, wherein the conductive materials include chromium and gold.

8. The method of fabricating a thin film resistor of claim 1, wherein the conductive material includes an adhesion layer over the TiC pattern.

9. The method of fabricating a thin film resistor of claim 8, wherein the adhesion layer includes titanium.

10. The method of fabricating a thin film resistor of claim 8, wherein the adhesion layer includes chromium.

11. The method of fabricating a thin film resistor of claim 1, further comprising the step of:

annealing the thin film resistor.

12. The method of fabricating a thin film resistor of claim 1, further comprising the step of:

packaging the thin film resistor.

13. An electronics component, comprising:

a substrate;

a titanium carbide (TiC) thin film layer patterned on the substrate; and conductive terminals formed to provide ohmic contacts on opposite ends of the TiC thin film layer to provide a TiC thin film resistor;

wherein the TiC thin film layer has a crystalline structure mimicking the crystallinity of a target utilized during a room temperature pulsed-laser deposition process of depositing the TiC thin film layer on the substrate.

14. The electronics component of claim 13, wherein the conductive terminals include an adhesion layer adjacent to the TiC thin film layer.

15. The electronics component of claim 14, wherein the adhesion layer includes chromium.

16. The electronics component of claim 13, wherein the substrate is formed from one or more of: silicon on sapphire, silicon oxide, sapphire, and alumina.

17. The electronics component of claim 13, wherein the substrate is formed from silicon on sapphire.

18. The electronics component of claim 13, wherein the TiC thin film layer is polycrystalline.

19. The electronics component of claim 13, wherein the conductive terminals include a tri-layer contact of titanium, chromium, and gold portions.

20. The electronics component of claim 13, wherein the conductive terminals include TiC, chromium and gold.

21. The electronics component of claim 14, wherein the adhesion layer includes titanium.

* * * * *